US009988226B2

(12) United States Patent
Hamaya et al.

(10) Patent No.: US 9,988,226 B2
(45) Date of Patent: Jun. 5, 2018

(54) PAPER CONVEYING APPARATUS AND IMAGE FORMING APPARATUS

(71) Applicant: Konica Minolta, Inc., Chiyoda-ku, Tokyo (JP)

(72) Inventors: Satoshi Hamaya, Hachioji (JP); Mikihiro Yamakawa, Kodaira (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days. days.

(21) Appl. No.: 15/462,464

(22) Filed: Mar. 17, 2017

(65) Prior Publication Data

US 2017/0299997 A1 Oct. 19, 2017

(30) Foreign Application Priority Data

Apr. 13, 2016 (JP) ..... 2016-079962

(51) Int. Cl.
*B65H 9/00* (2006.01)
*B65H 7/20* (2006.01)

(52) U.S. Cl.
CPC ..... *B65H 9/006* (2013.01); *B65H 7/20* (2013.01); *B65H 2515/704* (2013.01); *B65H 2557/33* (2013.01)

(58) Field of Classification Search
CPC ..... B65H 9/004; B65H 9/006; B65H 7/20; B65H 2515/704
See application file for complete search history.

(56) References Cited

U.S. PATENT DOCUMENTS 8,099,037 B2 * 1/2012 Sekine ..... B65H 9/002 271/228
8,308,159 B1 * 11/2012 Manor ..... B65H 9/004 271/226
8,424,872 B2 * 4/2013 Iwakawa ..... B65H 5/062 271/227
8,596,637 B2 * 12/2013 Ogawa ..... B65H 5/26 271/264
8,651,475 B2 * 2/2014 Matsui ..... B65H 1/14 271/114
8,905,401 B2 * 12/2014 Nakagaki ..... B65H 9/004 271/228

(Continued)

FOREIGN PATENT DOCUMENTS

JP 2014-77826 A 5/2014

*Primary Examiner* — Patrick Cicchino
(74) *Attorney, Agent, or Firm* — Squire Patton Boggs (US) LLP

(57) ABSTRACT

A paper conveying apparatus and an image forming apparatus are described which can appropriately convey a sheet when the sheet is restarted after forming a loop. The paper conveying apparatus includes a conveying roller pair in the upstream side of a loop roller pair, a stepping motor for rotationally driving the conveying roller pair, and a processor for controlling rotation of the stepping motor by controlling pulse signals and excitation current supplied to the stepping motor. This processor halts rotation of the conveying roller pair by stopping output of the pulse signals when loop formation of the sheet is completed, and switches the excitation current to a lower current value which is lower than a reference current value at which excitation is turned on.

13 Claims, 5 Drawing Sheets

(56) References Cited

U.S. PATENT DOCUMENTS 8,910,936 B2 * 12/2014 Tsou ..... B65G 47/24
198/395
8,950,747 B2 * 2/2015 Kikuchi ..... G03G 15/6561
271/242

* cited by examiner

PAPER CONVEYING APPARATUS AND IMAGE FORMING APPARATUS

CROSS-REFERENCE TO RELATED APPLICATIONS

The present application claims priority under 35 U.S.C. § 119 to Japanese Patent Application No. 2016-079962, filed Apr. 13, 2016. The contents of this application are herein incorporated by reference in their entirety.

BACKGROUND OF THE INVENTION

Field of the Invention

The present invention relates to a paper conveying apparatus and an image forming apparatus.

Description of the Related Art

For example, Japanese Patent Published Application No. 2014-77826 discloses an image forming apparatus which forms a loop of a sheet by transferring the sheet from a conveyance roller pair to a pre-resist roller pair (loop roller pair), and then making the leading edge of the sheet collide with the paper stop roller pair. In accordance with this image forming apparatus, while performing skew correction, the sheet can be transferred to a second transfer roller by starting the rotation of the paper stop roller pair with the loop being formed.

The two rollers of the roller pair for forming a loop have to be rotated in synchronization with each other, and therefore a stepping motor is generally used as a motor for driving the two rollers.

During a sheet conveyance process in which a loop is formed, conveyance of the sheet may be halted after formation of the loop followed by restarting the conveyance of the sheet. In this case, with a sheet being stopped, a large reaction force is exerted on the roller pair depending upon the configuration of the conveying route and the type of the sheet so that the stepping motor may be brought under a high load condition. If starting conveyance of the sheet again under such a high load condition, there is the possibility that a step-out occurs to hinder the sheet from being appropriately conveyed.

Taking into consideration the above circumstances, it is an object of the present invention therefore to provide a paper conveying apparatus and an image forming apparatus which can appropriately convey a sheet when the sheet is restarted after forming a loop.

SUMMARY OF THE INVENTION

To achieve at least one of the above-mentioned objects, reflecting one aspect of the present invention, a paper conveying apparatus which forms a loop of a sheet between a paper stop roller pair and a loop roller pair arranged in an upstream side of the paper stop roller pair, and halts conveyance of the sheet, comprises: a conveying roller pair arranged in an upstream side of the loop roller pair; a stepping motor which rotationally drives the conveying roller pair; and a processor which controls rotation of the stepping motor by controlling pulse signals and excitation current supplied to the stepping motor, wherein the processor halts rotation of the conveying roller pair by stopping output of the pulse signals when loop formation of the sheet is completed, and switches the excitation current to a lower current value which is lower than a reference current value at which excitation is turned on.

In accordance with another aspect of the present invention, an image forming apparatus comprises: a paper conveying apparatus which forms a loop of a sheet between a paper stop roller pair and a loop roller pair arranged in an upstream side of the paper stop roller pair, and halts conveyance of the sheet; and an image forming unit which forms an image on a sheet conveyed from the paper stop roller pair. Particularly, the paper conveying apparatus comprises: a conveying roller pair arranged in an upstream side of the loop roller pair; a stepping motor which rotationally drives the conveying roller pair; and a processor which controls rotation of the stepping motor by controlling pulse signals and excitation current supplied to the stepping motor, wherein the processor halts rotation of the conveying roller pair by stopping output of the pulse signals when loop formation of the sheet is completed, and switches the excitation current to a lower current value which is lower than a reference current value at which excitation is turned on.

DETAILED DESCRIPTION OF THE PREFERRED EMBODIMENT

Figure 1:
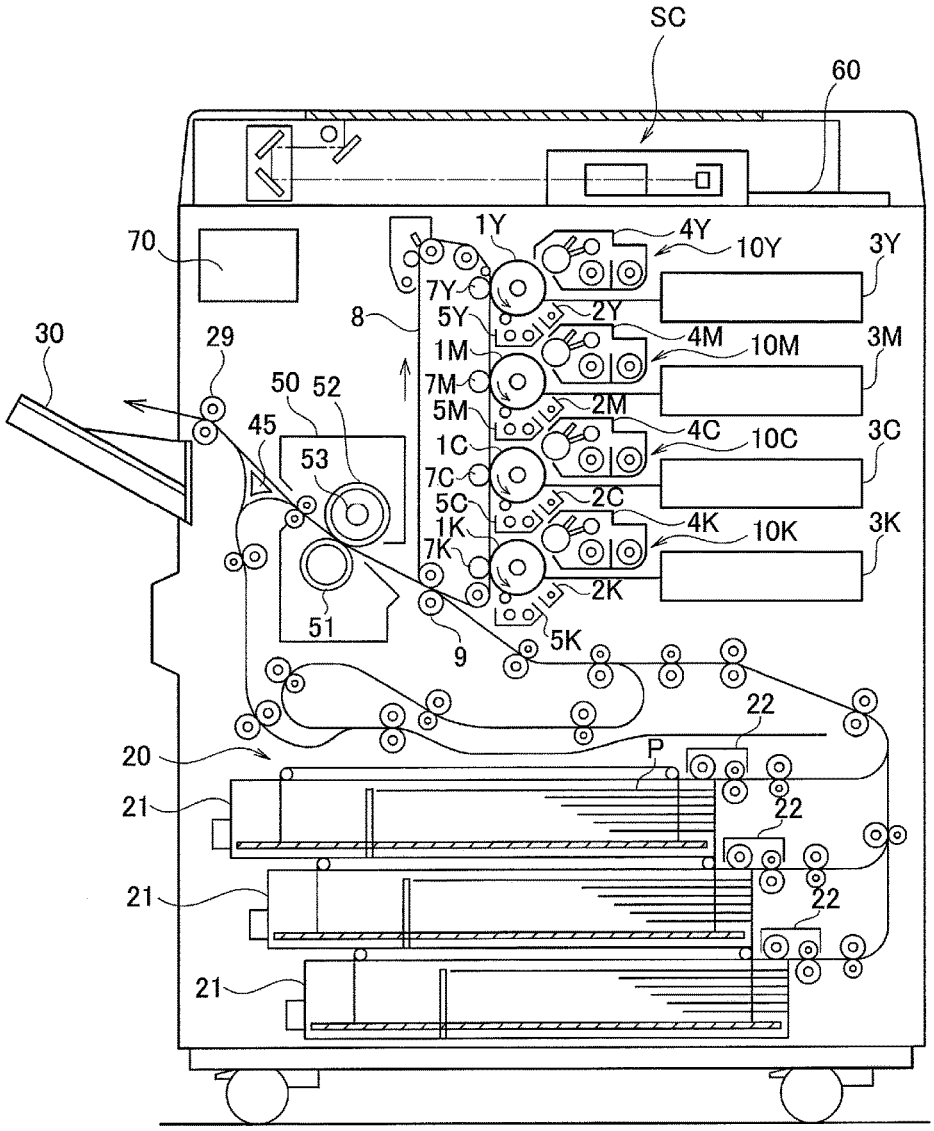
FIG. 1 is a view for schematically showing the configuration of an image forming apparatus in accordance with an embodiment.
Figure 2:
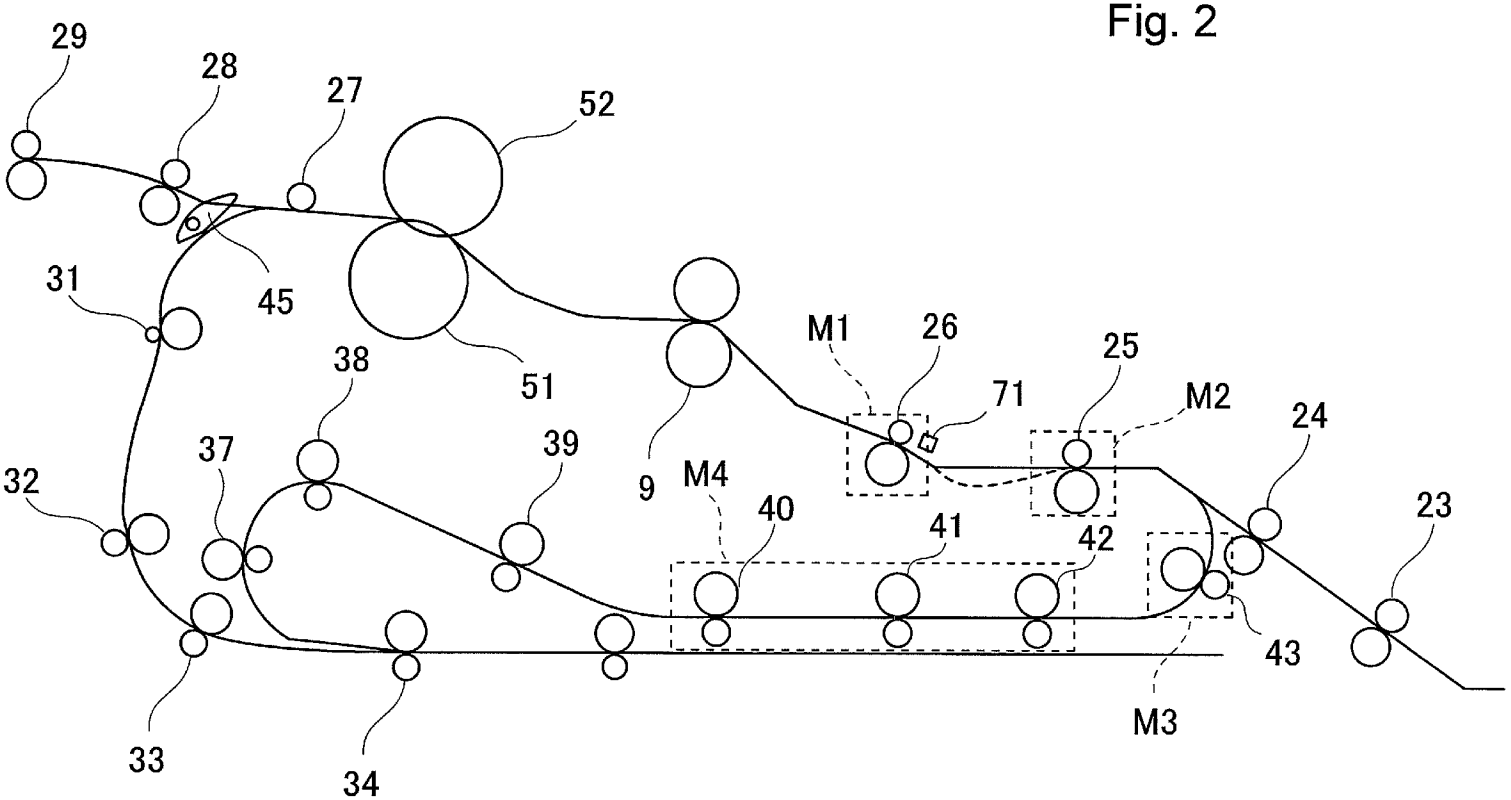
FIG. 2 is a view for showing the configuration of the key parts of the image forming apparatus focusing on conveying routes of a sheet.

FIG. 1 is a view for schematically showing the configuration of an image forming apparatus in accordance with an embodiment. FIG. 2 is a view for showing the configuration of the key parts of the image forming apparatus focusing on conveying routes of a sheet P. The image forming apparatus in accordance with the present embodiment is, for example, an electrophotographic image forming apparatus called a tandem color image forming apparatus which forms full-color images.

The image forming apparatus consists mainly of an original reading unit SC, image forming units 10Y, 10M, 10C and 10K, a paper conveying unit 20, a fixing unit 50, and a control unit 70.

The original reading unit SC irradiates an image of an original with a lighting device, and reads light reflected therefrom with a line image sensor to obtain an image signal. This image signal is processed by performing A/D conversion, shading compensation, data compression and so on, and then input to the control unit 70 as image data. Incidentally, the image data input to the control unit 70 is not limited to the image data as captured by the original reading unit SC, but can be the data for example as received from another image forming apparatus body, a personal computer or the like connected to the image forming apparatus, or stored in a portable recording medium such as a USB memory.

These image forming units 10Y, 10M, 10C and 10K are an image forming unit 10Y for forming yellow (Y) images, an image forming unit 10M for forming magenta (M) images, an image forming unit 10C for forming cyan (C) images, and an image forming unit 10K for forming black (K) images.

The image forming unit 10Y consists of a photoreceptor drum 1Y, and a charging unit 2Y, an optical writing unit 3Y, a development apparatus 4Y and a drum cleaner 5Y which are arranged around the photoreceptor drum 1Y. The photoreceptor drum 1Y is uniformly charged with electricity on its surface by the charging unit 2Y, and the optical writing unit 3Y performs a scanning exposure process to form a latent image on the photoreceptor drum 1Y. The development apparatus 4Y then makes visible the latent image on the photoreceptor drum 1Y by developing the image with toner. A toner image (toner image) is thereby formed on the photoreceptor drum 1Y corresponding to yellow. The image formed on the photoreceptor drum 1Y is transferred to a predetermined location of an intermediate transfer belt 8, which is an endless belt, by a first transfer roller 7Y.

Likewise, the other image forming units 10M, 10C and 10K are provided with photoreceptor drums 1M, 1C and 1K, and charging units 2M, 2C and 2K, optical writing units 3M, 3C and 3K, development apparatuses 4M, 4C and 4K, drum cleaners 5M, 5C and 5K which are arranged around the photoreceptor drums 1M, 1C and 1K respectively. These elements have the similar structure and function as the image forming unit 10Y.

The intermediate transfer belt 8 is wound around a plurality of rollers including a second transfer opposite roller and a belt follower roller. After transferred to the intermediate transfer belt 8, the toner images are transferred by a second transfer roller 9 to a sheet P which is conveyed with a predetermined timing by a paper feed unit 20. The second transfer roller 9 is brought into pressure contact with the second transfer opposite roller through the intermediate transfer belt 8 (second transfer nip).

The paper conveying unit 20 conveys a sheet P along conveying routes (a main conveying route, a sheet reversing conveying route, and a double-side conveying route). Sheets P are accommodated in a paper tray 21, taken in by a paper feed unit 22, and fed out to the main conveying route.

As illustrated in FIG. 2, two intermediate conveyance roller pairs 23 and 24, a loop roller pair 25, a paper stop roller pair 26 and the like are provided in the upstream side of the second transfer roller 9 on the main conveying route. These roller pairs 23, 24, 25 and 26 are arranged from the upstream side to the downstream side in the sheet conveying direction in this order.

After passing through the two intermediate conveyance roller pairs 23 and 24, a sheet P fed from the paper tray 21 is conveyed by the loop roller pair 25 to collide with the paper stop roller pair 26 being in the rotation halted state. Even after colliding with the paper stop roller pair 26, the sheet P is continuously conveyed by roller pairs which are located in the upstream side of the paper stop roller pair 26. Accordingly, the sheet P is continuously conveyed by the two intermediate conveyance roller pairs 23 and 24 and the loop roller pair 25 with the leading edge of the sheet P being stopped by the paper stop roller pair 26. A loop of the sheet P is therefore formed between the paper stop roller pair 26 and the loop roller pair 25.

The loop formed by such a series of loop formation steps is formed in an appropriate profile and a sufficient amount by a guide member which is not shown in the figure. After forming a loop of a sheet P, conveyance of the sheet P is halted by halting the rotation of the roller pairs located in the upstream side of the paper stop roller pair 26, i.e., the two intermediate conveyance roller pairs 23 and 24 and the loop roller pair 25.

Next, it is determined to restart conveying the sheet P by starting the rotation of the paper stop roller pair 26, the loop roller pair 25 and the two intermediate conveyance roller pairs 23 and 24. The sheet P stopped by colliding with the paper stop roller pair 26 is then conveyed with an accurate timing, while performing skew correction, and transferred to the second transfer nip.

Referring again to FIG. 1, the fixing unit 50 is a device which performs a fixing process for fixing an image to a sheet P to which the image has been transferred. The fixing unit 50 is provided with a pair of fixing rollers 51 and 52 which are arranged in contact with each other under pressure to form a nip (fixing nip) therebetween, and a heating device 53 for heating the fixing roller 52. The heating device 53 can be a heater such as a halogen lamp. The fixing unit 50 conveys a sheet P and fixes an image to the sheet P by pressure fixing with the pair of fixing rollers 51 and 52 and thermal fixing with the heating device 53.

After the fixing process, the sheet P is conveyed through the main conveying route in the downstream side of the fixing nip and discharged to a catch tray 30 which is provided on the side of the housing. There are provided a fixing discharging roller 27, a discharging conveyance roller pair 28 and a discharging roller pair 29 on this main conveying route. These roller pairs 27, 28 and 29 are arranged from the upstream side to the downstream side in the sheet conveying direction in this order. The fixing discharging roller 27, the discharging conveyance roller pair 28 and the discharging roller pair 29 serve as elements for constructing the paper conveying unit 20 for conveying a sheet P.

In the case where an image is to be formed also on the back side of a sheet P, as illustrated in FIG. 2, a switching gate 45 located between the fixing discharging roller 27 and the discharging conveyance roller pair 28 is switched. After finishing image formation on the front side of a sheet P, the sheet P is transferred to the reversing conveying route by the switching operation of the switching gate 45.

Provided on the reversing conveying route are a decurler roller pair 31, two reversing conveying roller pairs 32 and 33 and a reversing roller pair 34. The roller pairs 31, 32, 33 and 34 are arranged from the upstream side to the downstream side in the sheet conveying direction in this order. The decurler roller pair 31, the two reversing conveying roller pairs 32 and 33 and the reversing roller pair 34 serve also as elements for constructing the paper conveying unit 20 for conveying a sheet P. When the reversing roller 34 is reached by the tail edge of a sheet P which is conveyed by these roller pairs 31, 32, 33 and 34, the sheet P is switched back by the reversing operation of the reversing roller pair 34. The sheet P is then transferred to the double-side conveying route.

Seven double-side conveying roller pairs 37 to 43 are provided on the double-side conveying route and arranged from the upstream side to the downstream side in the sheet conveying direction in this order. The seven double-side conveying roller pairs 37 to 43 serve also as elements for constructing the paper conveying unit 20 for conveying a sheet P. The sheet P conveyed by the double-side conveying roller pairs 37 to 43 is returned to the main conveying route through the junction point between the loop roller pair 25 and the intermediate conveyance roller pair 24.

The sheet P conveyed from the double-side conveying route is conveyed by the loop roller pair 25 and collides with the paper stop roller pair 26 being in the rotation halted state. Even after colliding with the paper stop roller pair 26, the sheet P is continuously conveyed by roller pairs (the loop roller pair 25, the double-side conveying roller pair 42, the double-side conveying roller pair 43 and the like) which are located in the upstream side of the paper stop roller pair 26. Accordingly, the sheet P is continuously conveyed by the loop roller pair 25, the double-side conveying roller pair 42, the double-side conveying roller pair 43 and the like with the leading edge of the sheet P being stopped by the paper stop roller pair 26. A loop of the sheet P is therefore formed between the paper stop roller pair 26 and the loop roller pair 25.

The loop formed by such a series of loop formation steps is formed in an appropriate profile and a sufficient amount by a guide member which is not shown in the figure. After forming a loop of a sheet P, conveyance of the sheet P is halted by halting the rotation of the roller pairs located in the upstream side of the paper stop roller pair 26, i.e., the loop roller pair 25, the double-side conveying roller pair 42, the double-side conveying roller pair 43 and the like.

Next, it is determined to restart conveying the sheet P by starting the rotation of the paper stop roller pair 26 and the roller pairs (the loop roller pair 25, the double-side conveying roller pair 42, the double-side conveying roller pair 43 and the like) which is located in the upstream side of the paper stop roller pair 26. The sheet P stopped by colliding with the paper stop roller pair 26 is then conveyed with an accurate timing, while performing skew correction, and transferred to the second transfer nip.

The double-side conveying route is designed to have a curved route shape. This is because there is the necessity of meeting the requirement for miniaturization of the main body of the image forming apparatus while keeping a necessary route length for conveying a sheet P. For example, since the conveyance direction of a sheet P has to be changed almost by 180° in the downstream side area of the double-side conveying route where the sheet P enters the main conveying route, the double-side conveying route has a route shape curved with a small curvature radius in this area.

The double-side conveying roller pair 43 provided in the most downstream side is located in a curved route portion of the double-side conveying route. On the other hand, the double-side conveying roller pair 42 located in the upstream side of the double-side conveying roller pair 43, and two double-side conveying roller pairs 40 and 41, are located in the positions for transferring a sheet P to the curved route portion. The double-side conveying roller pairs 40, 41, 42 and 43 located in such positions have to pass a sheet P, even a high rigidity sheet such as a cardboard, through the curved route portion, and therefore given high conveying powers.

Referring again to FIG. 1, the operation panel 60 is an input unit in the form of a touch panel through which information can be input in accordance with information displayed on a display. A user can set a variety of parameters such as information about a sheet P (the type of paper and the like), the density and reduce/enlarge ratio of an image and so forth through operation of the operation panel 60. The information which is set is input to the control unit 70. Also, the operation panel 60 is controlled by the control unit 70 to display various information to a user through the operation panel 60 itself.

The control unit 70 is responsible for controlling the operation of the image forming apparatus. The control unit 70 is implemented with a microcomputer which consists mainly of a CPU, a ROM, a RAM, and an I/O interface.

The CPU controls the operation of the image forming apparatus 100 by running various programs. The ROM stores the various programs to be run by the CPU in the form of program codes which can be read by the CPU. On the other hand, the ROM stores data which is needed for running the programs. The RAM is a memory for providing a working storage area. The programs and data stored in the ROM are read by the CPU and developed in the RAM. Then, the CPU performs various processes based on the program and data developed in the RAM.

The control unit 70 controls the image forming units 10Y, 10M, 10C and 10K and the like to form an image on a sheet P, and controls the fixing unit 50 to fix the image on the sheet P.

Also, the control unit 70 controls the paper conveying unit 20 to control the conveying state of a sheet P. The control unit 70 receives detection signals from paper detecting sensors to monitor the conveying state of a sheet P which is conveyed through the conveying route. The paper detecting sensors are arranged in several positions on the conveying route. For example, a paper detecting sensor 71 is located before (in the upstream side of) the paper stop roller pair 26 (refer to FIG. 2).

Figure 3A:
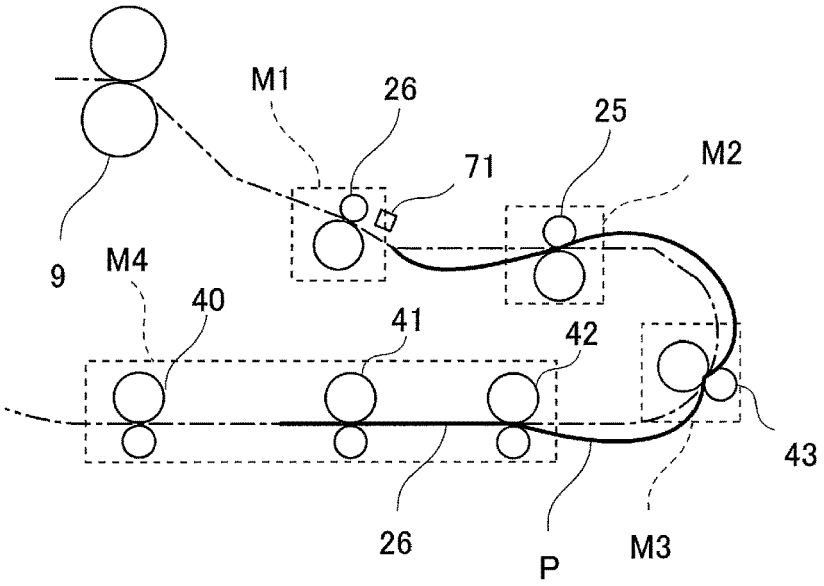
FIG. 3A is an explanatory view for showing a sheet conveying state in the case where the control of the present embodiment is not applied.
Figure 3B:
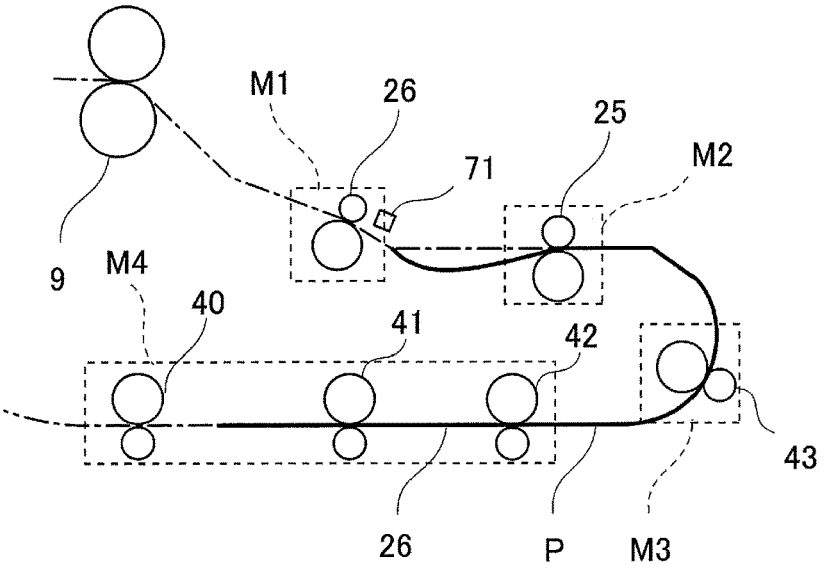
FIG. 3B is an explanatory view for showing a sheet conveying state in the case where the control of the present embodiment is applied.

In what follows, the concept of control by the control unit 70 will be explained in advance of explanation of specific control operations to be performed by the control unit 70. FIG. 3A and FIG. 3B are explanatory views for showing the control concept of the control unit 70. Particularly, FIG. 3A is an explanatory view for showing a sheet conveying state in the case where the control of the present embodiment is not applied, and FIG. 3B is an explanatory view for showing a sheet conveying state in the case where the control of the present embodiment is applied.

In the image forming apparatus of the present embodiment, a loop formation operation is performed for forming a loop of a sheet P between the paper stop roller pair 26 and the loop roller pair 25. This loop formation operation is performed either in the case where the sheet P is conveyed from the paper tray 21 or in the case where the sheet P is conveyed from the double-side conveying route. In the following explanation, it is assumed that the loop formation operation is performed in the later case.

When a loop is formed, the same sheet P is held by the loop roller pair 25 and the roller pair located in the upstream side thereof. For example, as illustrated in FIG. 3, when a loop is formed, the same sheet P is held by the loop roller pair 25 and the double-side conveying roller pairs 41, 42 and 43 located in the upstream side thereof. During the loop formation operation, it is needed to rotate these roller pairs 25, 41, 42 and 43 in synchronization with each other, and therefore stepping motors are used to drive these roller pairs.

Specifically, the paper stop roller pair 26 is rotationally driven alone by a stepping motor M1, and the loop roller pair 25 is rotationally driven alone by a stepping motor M2. Also, in the double-side conveying route, the double-side conveying roller pair 43 which is located in the most downstream side is rotationally driven alone by a stepping motor M3. On the other hand, a stepping motor M4 is commonly used to rotationally drive the three double-side conveying roller pairs 40, 41 and 42 located in the upstream side of the double-side conveying roller pair 43 which is located in the most downstream side.

During the loop formation operation, the sheet P transferred from the double-side conveying route is conveyed by the loop roller pair 25, the double-side conveying roller pair 43, the double-side conveying roller pair 42 and the double-side conveying roller pair 41 to collide with the paper stop roller pair 26 being in the rotation halted state. Even after colliding with the paper stop roller pair 26, the sheet P is continuously conveyed by these roller pairs 25, 41, 42 and 43. A loop of the sheet P is therefore formed between the paper stop roller pair 26 and the loop roller pair 25.

Meanwhile, when starting loop formation, a force of releasing the loop (the reaction force of the sheet P) is exerted on the sheet P due to the rigidity of the sheet P. Slip may thereby occur between the loop roller pair 25 and the sheet P so that the sheet P may not appropriately be transferred by the loop roller pair 25. On the other hand, high conveying powers are given to the double-side conveying roller pairs 41, 42 and 43 which are roller pairs located in the curved route portion or roller pairs responsible for transferring the sheet P to the curved route portion. Because of this, the double-side conveying roller pairs 41, 42 and 43 can convey the sheet P without slip so that a loop is formed between the loop roller pair 25 and the double-side conveying roller pair 43 (refer to FIG. 3A).

Also, when starting loop formation between the loop roller pair 25 and the double-side conveying roller pair 43, a force of releasing the loop (the reaction force of the sheet P) is exerted on the sheet P due to the rigidity of the sheet P. In the same manner as the loop roller pair 25, thereby, slip may occur between the double-side conveying roller pair 43 and the sheet P so that the sheet P may not appropriately be transferred by the double-side conveying roller pair 43. As a result, a similar phenomenon may occur also between the double-side conveying roller pair 43 and the double-side conveying roller pair 42 which is located in the upstream side thereof.

On the other hand, when the loop formation operation is finished, the rotation of the roller pairs located in the upstream side of the paper stop roller pair 26 is halted. In this case, reaction forces exerted on the double-side conveying roller pairs 42 and 43 and the like are caused by loops which are secondarily formed (for example, a loop between the loop roller pair 25 and the double-side conveying roller pair 43, a loop between the double-side conveying roller pair 43 and the double-side conveying roller pair 42 and the like), and the rigidity of the sheet P. The stepping motors M3 and M4 for rotationally driving the double-side conveying roller pairs 42 and 43 are thereby placed in high load states. Particularly, the stepping motor M4 receives forces from the two double-side conveying roller pairs 41 and 42 holding the sheet P so that a higher load is exerted on the stepping motor M4.

If starting conveyance of the sheet P again under such a high load condition, a step-out may occur when starting the rotation of the stepping motors M3 and M4 and accelerating the rotational speeds thereof. Because of this, there is the possibility that the sheet P cannot appropriately be conveyed. Particularly, this phenomenon becomes remarkable when conveying a high rigidity sheet such as a cardboard.

In the case of the present embodiment, thereby, when stopping a sheet P after finishing the loop formation operation of the sheet P, or after stopping the sheet P, a torque (static torque) is released (reduced) from the stepping motors M3 and M4 which rotationally drives the double-side conveying roller pairs 41, 42 and 43 in the upstream side of the loop roller pair 25. The reaction force of a sheet P can thereby be absorbed by permitting inversion (reverse rotation) of the double-side conveying roller pairs 41, 42 and 43.

Specifically, the control unit 70 stops output of pulse signals in synchronization with the completion of the loop formation operation of a sheet P to halt the rotation of the double-side conveying roller pairs 41, 42 and 43, and turns off excitation current (excitation off). The output shafts of the stepping motors M3 and M4 can freely rotate in this condition. The double-side conveying roller pairs 41, 42 and 43 are thereby reversely rotated by the reaction force of a sheet P which then resumes a necessary state to conform to the profile of the route. It is thereby avoided that high loads are exerted on the stepping motors M3 and M4. The step-out at restart can thereby be inhibited from occurring so that a sheet P can be conveyed appropriately.

Also, when restarting conveying a sheet P in the case of the present embodiment, the control unit 70 starts outputting pulse signals to the stepping motors M3 and M4 on the condition that a predetermined excitation period elapses after turning on the excitation of the stepping motors M3 and M4. Namely, when a sheet P is restarted, the control unit 70 starts outputting pulse signals after a predetermined excitation period from a time at which the excitation current is returned to the reference current value at which excitation is turned on.

When switching the current supplied to the stepping motors M3 and M4 from off to on, excitation current is passed through the stepping motors M3 and M4 so that the output shafts of the motors are changed from free states to engaged states in which the output shafts are engaged with gears or the like (members for transmitting power to the double-side conveying roller pairs 41, 42 and 43) after rotating a very small angle. The above excitation period is provided for securing a stand-by period when the excitation current is turned on, i.e., the period between when the excitation current is turned on and the output shafts of the motors are engaged with the gears or the like. The excitation period is set in advance to a value according to the characteristics of the stepping motors M3 and M4 through experiments and simulations.

Figure 4:
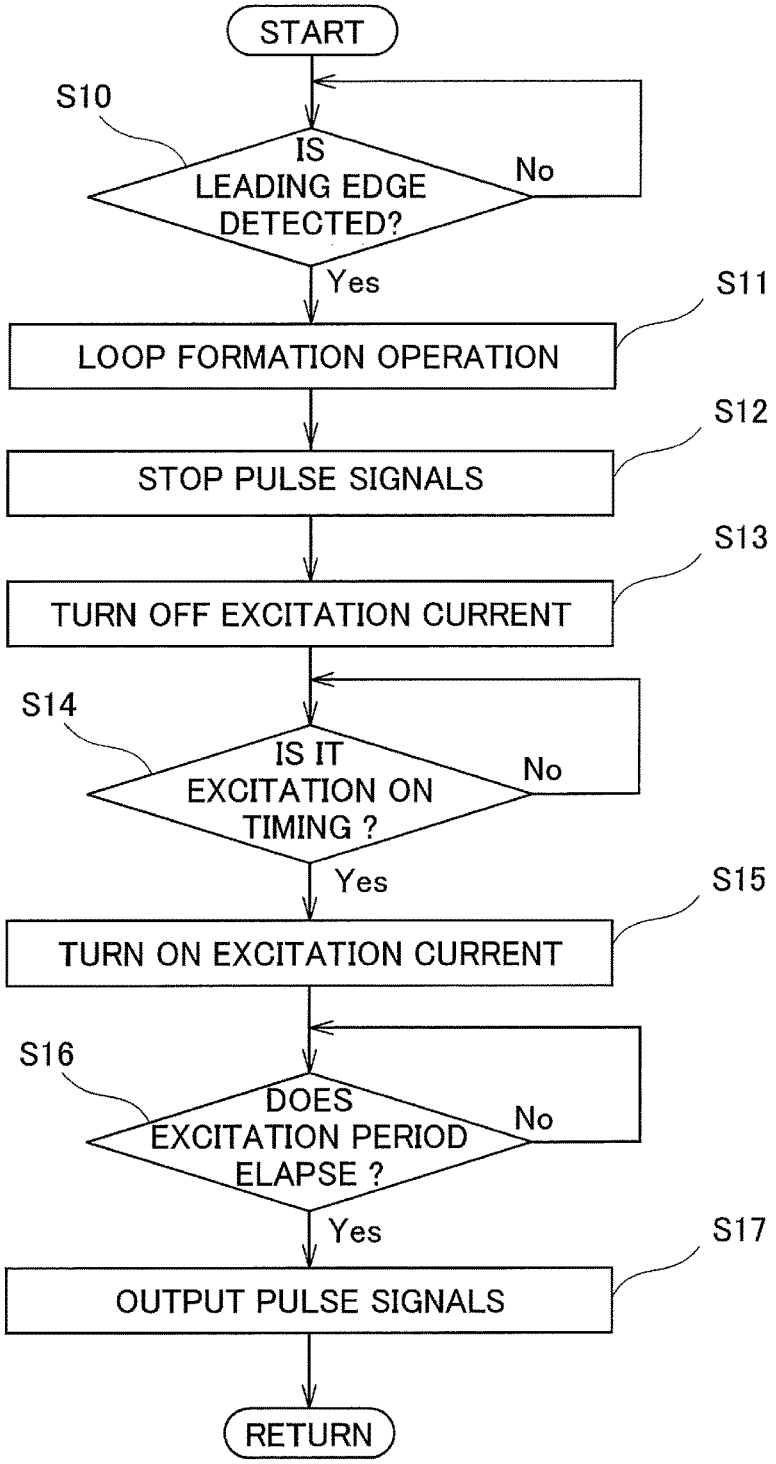
FIG. 4 is a flow chart for showing the control operation of the image forming apparatus in accordance with the present embodiment.
Figure 5:
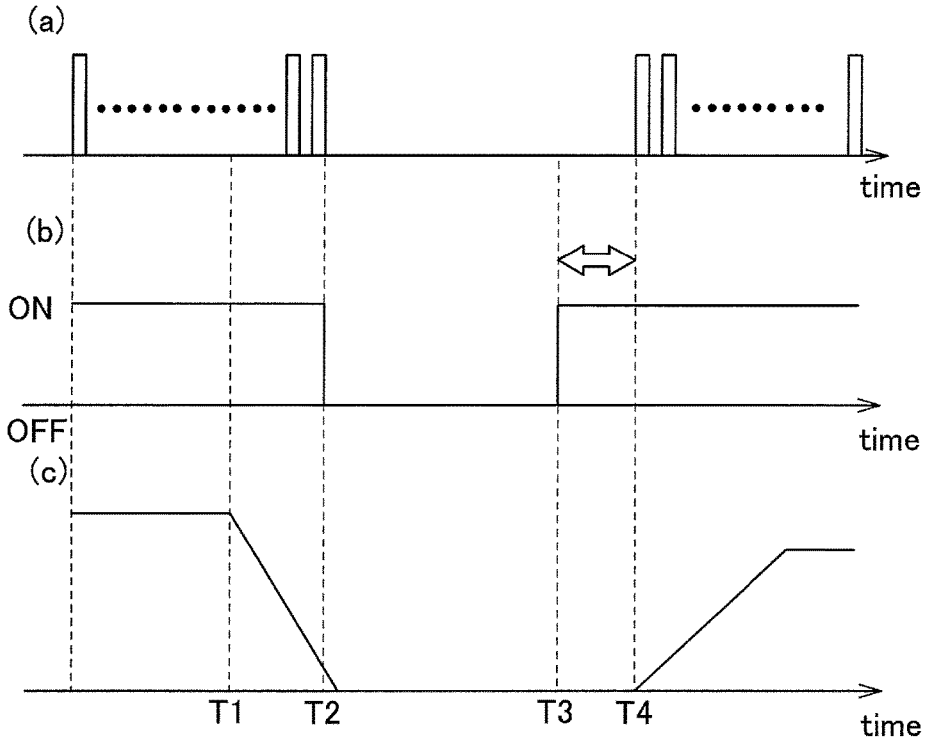
FIG. 5 is a timing chart for showing pulse signals ((a)) output to a stepping motor, excitation current ((b)), and the line speed ((c)) of a double-side conveying roller pair which is rotationally driven by the stepping motor.

Next, the control operation of the image forming apparatus will be explained in accordance with the present embodiment. FIG. 4 is a flow chart for showing the control operation of the image forming apparatus in accordance with the present embodiment. On the other hand, FIG. 5 is a timing chart for showing pulse signals ((a)) output to the stepping motor M4, the excitation current ((b)) and the line speed ((c)) of the double-side conveying roller pair 42 which is rotationally driven by the stepping motor M4. The process of this flow chart is performed by the control unit 70 on the condition that a sheet P is conveyed to the double-side conveying route.

First, in step 10 (S10), the control unit 70 determines whether or not the leading edge of the sheet P conveyed from the double-side conveying route to the main conveying route reaches the front of the paper stop roller pair 26, i.e., whether or not the paper detecting sensor 71 detects the leading edge of the sheet P. If the paper detecting sensor 71 does not detect the leading edge of the sheet P, the determination is in the negative in step 10, and step 10 is repeated. Conversely, if the paper detecting sensor 71 detects the leading edge of the sheet P, the determination is in the affirmative in step 10, and the process proceeds to step 11 (S11).

In step 11, the control unit 70 performs a loop formation operation. Specifically, the control unit 70 rotates the loop roller pair 25 and the double-side conveying roller pairs 41, 42 and 43. The sheet P conveyed from the double-side conveying route collides with the paper stop roller pair 26 being in the rotation halted state. Even after the sheet P collides with the paper stop roller pair 26, the loop roller pair 25 and the double-side conveying roller pairs 41, 42 and 43 are continuously rotated. A loop of the sheet P is therefore formed between the paper stop roller pair 26 and the loop roller pair 25. The loop formation operation is performed for a loop formation period (from time T1 to time T2) which is determined in advance in accordance with the amount of a loop to be formed.

In step 12 (S12), when the loop formation operation is completed (time T2), the control unit 70 stops outputting pulse signals supplied to the stepping motor M2 for rotationally driving the loop roller pair 25, the stepping motor M3 for rotationally driving the double-side conveying roller pair 43 and the stepping motor M4 for rotationally driving the double-side conveying roller pairs 40, 41 and 42

In step 13 (S13), the control unit 70 turns off the excitation current of the stepping motors M3 and M4 for rotationally driving the roller pairs in the upstream side of the loop roller pair 25, i.e., the double-side conveying roller pair 43 and the double-side conveying roller pairs 41 and 42 (excitation off).

However, the control unit 70 maintains the on state of the excitation current of the stepping motor M1 for rotationally driving the paper stop roller pair 26 and the stepping motor M2 for rotationally driving the loop roller pair 25. This is for the purpose of maintaining the loop formed between the paper stop roller pair 26 and the loop roller pair 25 by the static torques of the stepping motors M1 and M2.

In step 14 (S14), the control unit 70 determines whether or not it is the excitation on timing with which excitation current is turned on. In the case of the present embodiment, when restarting conveying a sheet P, i.e., when pulse signals are supplied to the stepping motors M3 and M4 whose excitation is turned off, the supply of pulse signals is started on the condition that a predetermined excitation period elapses after excitation is turned on. The excitation on timing is set to the timing the excitation period before conveying a sheet P is restarted. When the excitation on timing is not reached yet, the determination in step 14 is in the negative so that step 14 is repeated. Conversely, if it is the excitation on timing, the determination in step 14 is in the affirmative so that the process proceeds to step 15 (S15).

In step 15, the control unit 70 turns on the excitation current of the stepping motors M3 and M4 (excitation on) (time T3).

In step 16 (S16), the control unit 70 determines whether or not the excitation period elapses after excitation is turned on, i.e., whether or not it is the timing when conveying a sheet P is started. When the excitation period does not elapse yet, the determination is in the negative in step 16, and step 16 is repeated. Conversely, when the excitation period elapses, the determination is in the affirmative in step 16, and the process proceeds to step 17 (S17).

In step 17, the control unit 70 outputs pulse signals to the stepping motors M3 and M4 (time T4). Likewise, the control unit 70 outputs pulse signals to the stepping motor M1 for rotationally driving the paper stop roller pair 26 and the stepping motor M2 for rotationally driving the loop roller pair 25.

The image forming apparatus of the present embodiment thus performs the operation of forming a loop of a sheet P between the paper stop roller pair 26 and the loop roller pair 25 located in the upstream side thereof, and then halting conveyance of the sheet P. This image forming apparatus is provided with the double-side conveying roller pairs 41, 42 and 43 located in the upstream side of the loop roller pair 25, the stepping motors M3 and M4 for rotationally driving these double-side conveying roller pairs 41, 42 and 43, and the control unit 70 for controlling the stepping motors M3 and M4 by controlling pulse signals and excitation current supplied to the stepping motors M3 and M4. In this case, when the loop formation operation of a sheet P is completed, the control unit 70 stops the output of pulse signals to halt the rotation of the double-side conveying roller pairs 41, 42 and 43, and excitation current is turned off.

In accordance with this configuration, since the excitation current of the stepping motors M3 and M4 is turned off, the static torques of the stepping motors M3 and M4 are released. As a result, the double-side conveying roller pairs 41, 42 and 43 are reversely rotated to absorb the reaction force of a sheet P by the reaction force of the sheet P which then resumes a necessary state to conform to the profile of the route. It is thereby avoided that a sheet P is stopped while exerting high loads on the stepping motors M3 and M4. The step-out at restart of conveying a sheet P can thereby be inhibited from occurring so that the sheet P can be conveyed appropriately.

Also, when restarting conveying a sheet P in the case of the present embodiment, the control unit 70 starts outputting pulse signals when a predetermined excitation period elapses after turning on excitation (after excitation current resumes a base current value corresponding to an excitation on state).

In accordance with this configuration, pulse signals are supplied on the condition that the excitation period elapses. Because of this, when starting the supply of pulse signals after the stand-by period, the output shafts of the motors are engaged with gears or the like. When starting conveying a sheet P, thereby, the rotation of the stepping motors M3 and M4 is transmitted to the double-side conveying roller pairs 41, 42 and 43 without loss. As a result, it is possible to convey a sheet P with an accurate timing at restart, and transfer the sheet P to the second transfer nip.

Incidentally, if the productivity of the image forming apparatus is taken into consideration, it is conceived to output pulse signals without waiting for the end of the excitation period. However, if such an excitation period is not appropriately provided, a sheet P may not be conveyed with an accurate timing. Accordingly, in accordance with the scheme of the present embodiment, it is possible to accurately control the conveying timing of a sheet P and realize high-quality image formation. Needless to say, if a longer excitation period is provided, pulse signals can be supplied after excitation current has been surely supplied. However, this reduces the productivity so that it is preferred that the excitation period is set to a minimum required period by taking into consideration the motor characteristics.

Also, the double-side conveying roller pairs 41, 42 and 43 controlled by the stepping motors M3 and M4 are arranged in such positions as to convey a sheet P in the form of a loop, which is formed by the loop roller pair 25, in cooperation with the loop roller pair 25 itself.

The stepping motors M3 and M4 for rotationally driving the double-side conveying roller pairs 41, 42 and 43 may be brought under a high load condition by a reaction force of a sheet P. However, in accordance with the present invention as described above, the reaction force of a sheet P can be absorbed by turning off the excitation current of the stepping motors M3 and M4 to release the static torque of the stepping motors M3 and M4. Namely, the double-side conveying roller pairs 41, 42 and 43 are reversely rotated by the reaction force of a sheet P which then resumes a necessary state to conform to the profile of the route. It is thereby avoided that high loads are exerted on the stepping motors M3 and M4. As a result, the step-out at restart can be inhibited from occurring so that a sheet P can be conveyed appropriately.

Also, in the case of the present embodiment, the double-side conveying roller pairs 41, 42 and 43 controlled by the stepping motors M3 and M4 are arranged on the curved conveying route or in the positions for transferring a sheet P to the curved route portion.

The double-side conveying roller pairs 40, 41, 42 and 43 arranged on the curved conveying route have to surely pass a sheet P such as a cardboard, and therefore given high conveying powers. Because of this, when slip occurs at the roller pair in the downstream side, the double-side conveying roller pairs 41, 42 and 43 warp the sheet P, and therefore substantially receives the reaction force of the sheet P. However, in accordance with the present embodiment, since the excitation current of the stepping motors M3 and M4 is turned off, the static torques of the stepping motors M3 and M4 are released. As a result, the double-side conveying roller pairs 41, 42 and 43 are reversely rotated by a reaction force of the sheet P to absorb the reaction force of the sheet P which then resumes a necessary state to conform to the profile of the route. It is thereby avoided that a sheet P is stopped while exerting high loads on the stepping motors M3 and M4. The step-out at restart of conveying a sheet P can thereby be inhibited from occurring so that the sheet P can be conveyed appropriately.

Incidentally, in the case of the above embodiment, excitation current is turned off when the output of pulse signals is stopped to halt the rotation of the roller pairs.

Figure 6:
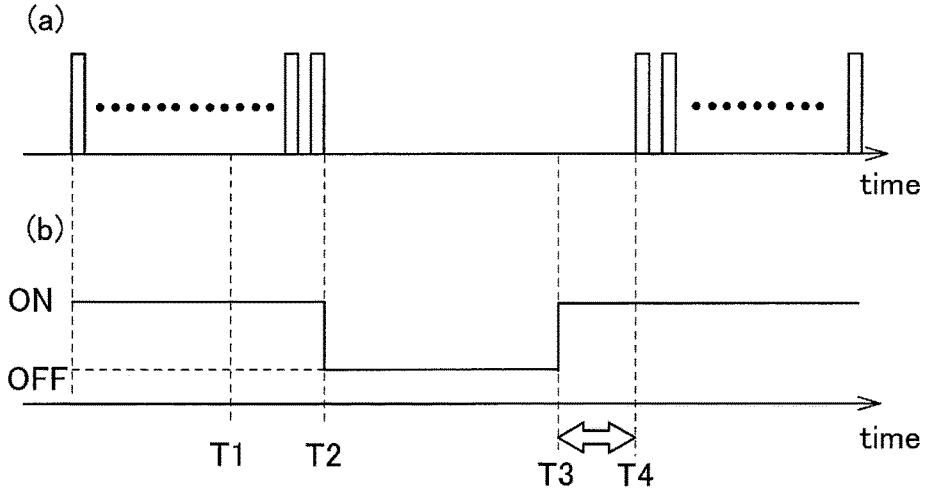
FIG. 6 is a timing chart for showing pulse signals ((a)) output to the stepping motor and excitation current ((b)).

However, in place of turning off excitation current, it is possible to switch the excitation current to a current value which is lower than a reference current value (the current value corresponding to an excitation on state) as illustrated in FIG. 6. In this case, the lower current value is set in order that the load torques exerted on the double-side conveying roller pairs 41, 42 and 43 from a sheet P are greater than the static torques exerted on the double-side conveying roller pairs 41, 42 and 43 from the stepping motors M3 and M4.

By this configuration, since the excitation current of the stepping motors M3 and M4 is decreased, the static torques of the stepping motors M3 and M4 are reduced. The load torques exerted on the double-side conveying roller pairs 41, 42 and 43 from a sheet P thereby exceed the static torques exerted on the double-side conveying roller pairs 41, 42 and 43 from the stepping motors M3 and M4. Because of this, the double-side conveying roller pairs 41, 42 and 43 are reversely rotated (in a step-out state) by the reaction force of a sheet P to absorb the reaction force of the sheet P which then resumes a necessary state to conform to the profile of the route. It is thereby avoided that a sheet P is stopped while exerting high loads on the stepping motors M3 and M4. The step-out at restart of conveying a sheet P can thereby be inhibited from occurring so that the sheet P can be conveyed appropriately.

The foregoing description has been presented based on the image forming apparatus according to the present invention. However, it is not intended to limit the present invention to the precise form described, and obviously many modifications and variations are possible within the scope of the invention. Also, the present invention can be considered to relate also to a paper conveying apparatus itself applied to the image forming apparatus. Furthermore, the paper conveying apparatus can be applied not only to the image forming apparatus, but also to a variety of apparatuses in which a sheet is conveyed while forming a loop.

Still further, in the embodiment as described above, when the rotation of the double-side conveying roller pairs is halted by stopping the output of pulse signals after completion of loop formation, excitation current is turned off (or decreased to a lower current value). The excitation current can be turned off (or decreased to the lower current) with the timing when the output of pulse signals is stopped, or with a timing delayed from this pulse signal stopping timing.

What is claimed is:

1. A paper conveying apparatus which forms a loop of a sheet between a paper stop roller pair and a loop roller pair arranged in an upstream side of the paper stop roller pair, and halts conveyance of the sheet, comprising:

a conveying roller pair arranged in an upstream side of the loop roller pair;

a stepping motor which rotationally drives the conveying roller pair; and a processor which controls rotation of the stepping motor by controlling pulse signals and excitation current supplied to the stepping motor, wherein the processor halts rotation of the conveying roller pair by stopping output of the pulse signals when loop formation of the sheet is completed, and switches the excitation current to a lower current value which is lower than a reference current value at which excitation is turned on, wherein the lower current value is set in order that a load torque exerted on the conveying roller pair from the sheet is greater than a static torque exerted on the conveying roller pair from the stepping motor.

2. The paper conveying apparatus of claim 1, wherein the lower current value is a value at which excitation is turned off.

3. The paper conveying apparatus of claim 1, wherein when the sheet is restarted, the processor starts outputting the pulse signals after a predetermined excitation period from a time at which the excitation current is returned to the reference current value at which excitation is turned on.

4. The paper conveying apparatus of claim 1, wherein the conveying roller pair is located in such a position as to hold the same sheet as the loop roller pair when the loop roller pair forms a loop.

5. The paper conveying apparatus of claim 1, wherein the conveying roller pair is arranged on a conveying route which is curved.

6. The paper conveying apparatus of claim 1, wherein the conveying roller pair is located in such a position as to transfer a sheet to a conveying route which is curved.

7. An image forming apparatus comprising:

a paper conveying apparatus which forms a loop of a sheet between a paper stop roller pair and a loop roller pair arranged in an upstream side of the paper stop roller pair, and halts conveyance of the sheet; and an image forming unit which forms an image on a sheet conveyed from the paper stop roller pair; wherein the paper conveying apparatus comprises:

a conveying roller pair arranged in an upstream side of the loop roller pair;

a stepping motor which rotationally drives the conveying roller pair; and a processor which controls rotation of the stepping motor by controlling pulse signals and excitation current supplied to the stepping motor, wherein the processor halts rotation of the conveying roller pair by stopping output of the pulse signals when loop formation of the sheet is completed, and switches the excitation current to a lower current value which is lower than a reference current value at which excitation is turned on, wherein the lower current value is set in order that a load torque exerted on the conveying roller pair from the sheet is greater than a static torque exerted on the conveying roller pair from the stepping motor.

8. The image forming apparatus of claim 7, wherein the conveying roller pair is arranged on a double-side conveying route which is used to convey a sheet to the image forming unit again for the purpose of forming an image on a back side of the sheet.

9. The image forming apparatus of claim 7, wherein the lower current value is a value at which excitation is turned off.

10. The image forming apparatus of claim 7, wherein when the sheet is restarted, the processor starts outputting the pulse signals after a predetermined excitation period from a time at which the excitation current is returned to the reference current value at which excitation is turned on.

11. The image forming apparatus of claim 7, wherein the conveying roller pair is located in such a position as to hold the same sheet as the loop roller pair when the loop roller pair forms a loop.

12. The image forming apparatus of claim 7, wherein the conveying roller pair is arranged on a conveying route which is curved.

13. The image forming apparatus of claim 7, wherein the conveying roller pair is located in such a position as to transfer a sheet to a conveying route which is curved.

* * * * *